US007311543B2

(12) United States Patent
Hanning et al.

(10) Patent No.: US 7,311,543 B2
(45) Date of Patent: Dec. 25, 2007

(54) BUS MODULE SYSTEM INCLUDING AN INTERNAL BUS BRIDGE CONNECTOR

(75) Inventors: Walter Hanning, Detmold (DE); Jens Schulze, Paderborn (DE); Rudolf Steinmeier, Detmold (DE); Herbert Fricke, Detmold (DE)

(73) Assignee: Weidmiller Interface GmbH & Co. KG, Detmold (DE)

( * ) Notice: Subject to any disclaimer, the term of this patent is extended or adjusted under 35 U.S.C. 154(b) by 51 days.

(21) Appl. No.: 11/403,447

(22) Filed: Apr. 13, 2006

(65) Prior Publication Data

US 2006/0266196 A1 Nov. 30, 2006

(30) Foreign Application Priority Data

Apr. 18, 2005 (DE) ..... 20 2005 006 237 U

(51) Int. Cl.
*H01R 11/22* (2006.01)

(52) U.S. Cl. ..... 439/268; 439/441

(58) Field of Classification Search ..... 439/115–116, 439/119, 121, 404, 715, 717, 716, 709, 76.1, 439/532, 282, 718–719, 848, 268, 439–441, 439/507–511; 361/732, 735, 637, 624, 728, 361/823, 601, 822, 759
See application file for complete search history.

(56) References Cited

U.S. PATENT DOCUMENTS

| | | | | |
|---|---|---|---|---|
| 4,171,861 | A * | 10/1979 | Hohorst | 439/94 |
| 4,245,877 | A * | 1/1981 | Auriana | 439/268 |
| 5,094,626 | A * | 3/1992 | Fabrizi et al. | 439/511 |
| 5,290,180 | A | 3/1994 | Hermann | |
| 5,615,079 | A | 3/1997 | Eggert | |
| 5,629,831 | A | 5/1997 | Eggert | |
| 6,322,399 | B1 | 11/2001 | Hanning | |
| 6,663,441 | B1 | 12/2003 | Alexandre | |
| 2004/0047101 | A1 | 3/2004 | Garcia | |

FOREIGN PATENT DOCUMENTS

| | | |
|---|---|---|
| DE | 94 20 097 U1 | 2/1996 |
| DE | 299 16 303 U1 | 3/2001 |
| DE | 101 56 214 A1 | 6/2003 |

* cited by examiner

*Primary Examiner*—Edwin A. Leon
(74) *Attorney, Agent, or Firm*—Lawrence E. Laubscher, Sr.; Lawrence E. Laubscher, Jr.

(57) ABSTRACT

A bridge connector arrangement includes a bridge member moveable between engaged and disengaged positions relative to a pair of adjacent electrical modules, thereby to connect and disconnect rows of female terminals on the modules, The bridge member carries a plurality of male bridging contacts that extend within the female terminals when the bridge member is in the engaged position, whereupon the male bridging contacts are biased by clamping springs into electrical engagement with stationary wall contacts mounted in the female terminals. Release members carried by the bridge member are operable both to release the clamping springs from the male contacts, and to displace the bridge member toward the disengaged position relative to the modules. The bridge member and the modules include a tongue and groove guide arrangement, thereby to fasten both modules together mechanically.

16 Claims, 4 Drawing Sheets

BUS MODULE SYSTEM INCLUDING AN INTERNAL BUS BRIDGE CONNECTOR

BACKGROUND OF THE INVENTION

1. Field of the Invention

A bridge connector arrangement includes a bridge member moveable between engaged and disengaged positions relative to a pair of adjacent electrical modules, thereby to connect and disconnect rows of female terminals on the modules, The bridge member carries a plurality of male bridging contacts that extend within corresponding female terminals when the bridge member is in the engaged position, whereupon the male bridging contacts are biased by clamping springs into electrical engagement with stationary wall contacts mounted within the female terminals. Release members carried by the bridge member are operable both to release the clamping springs from the male contacts, and to displace the bridge member toward the disengaged position relative to the modules. The bridge member and the modules include tongue and groove guide projection and slot means, thereby to mechanically connect the bridge member and the modules against lateral displacement.

2. Description of Related Art

As shown by the Eggert et al U.S. Pat. Nos. 5,615,079 and 5,629,831, and the Hanning U.S. Pat. No. 6,322,399, which are assigned to the same assignee as the instant invention, it is known in the patented prior art to mount control modules for automated buildings and the like on support rails in a control panel, and to provide bridging connectors between the modules, thereby to connect electrically the respective power supply or signal transmitting circuits contained therein. To connect the bus conductors of the adjacent modules, it is known to connect the conductors by pin and socket contacts, or by bus slides. However, it is often also required to provide additional mechanical couplings between the components to stabilize and/or to align the same, use being made of separate operating latch or coupling means.

The present invention was developed to provide a module bridging arrangement that provides not only a simple manual tool-free electrical connection between the components, but also affords a reliable stabilizing and aligning mechanical connection.

SUMMARY OF THE INVENTION

Accordingly, a primary object of the present invention is to provide a bridge connector arrangement including clamping spring means which, when the bridge body is in the engaged position relative to a pair of modules, clamp the male bridging contacts carried by the bridge body into electrical engagement with the stationary contacts of the associated female terminals on the associated modules, together with release means mounted on the bridge body that are manually operable both to release the spring clamping legs from the male contacts, and to displace the bridge body toward its disengaged position.

According to another object of the invention, the connector bridge body includes a guide projection that extends into a corresponding projecting guide hole formed in the top surfaces of the adjacent modules, tongue and groove means being provided for mechanically fastening the bridge member to the two modules, thereby to form a rigid assembly. The guide projection and guide hole may be coded to insure that the proper predetermined modules are connected together.

A more specific object of the invention is to provide at each end of the bridge body a release member that is generally U-shaped in cross-section and includes a base portion that extends transversely adjacent the end wall of the bridge body, and a pair of legs that extend longitudinally inwardly adjacent the side walls of the bridge body, the release member being manually swingable about pivot cam means provided on the leg portions, thereby displace the bridge member from the engaged position toward the disengaged position. During this swinging movement of the release member, a disengaging cam on the transverse base portion thereof serves to disengage the clamping springs from the male bridge contacts. Separate depressor elements operable simultaneously by the disengaging cam means are mounted in the female terminals above the clamping springs. Alternatively, the depressor means may be directly connected with the transverse base portion of the release member.

According to another object of the invention, fuse means or LED indicator means may be connected in series in the base portions of the U-shaped bridge conductors that extend through the bridge body.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

Figure 1:
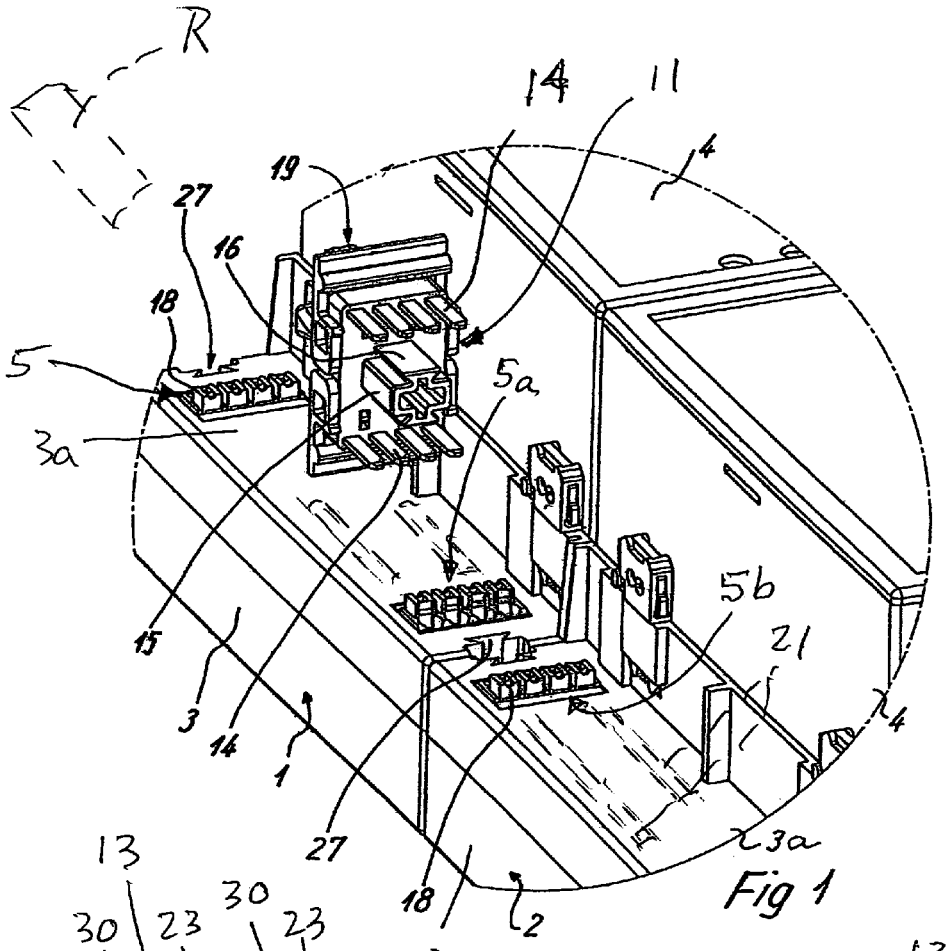
FIG. 1 is a detailed perspective view illustrating the bridge arrangement of the present invention with the bridge member in the fully disengaged position.
Figure 2A:
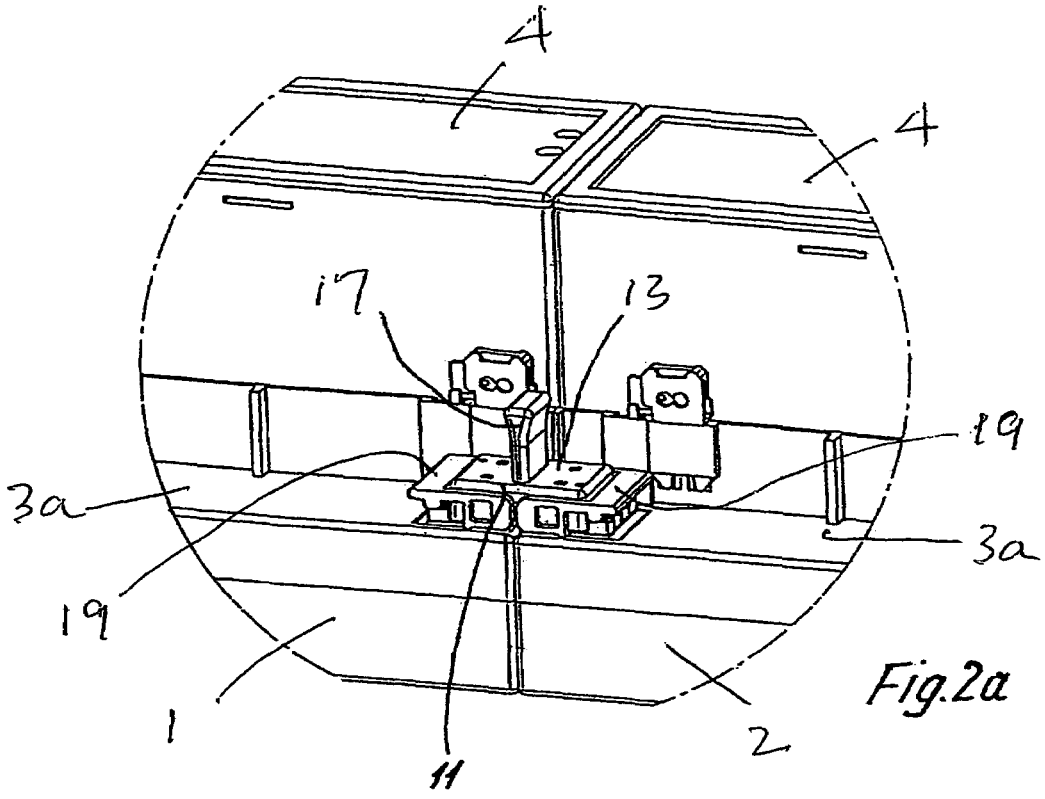
FIG. 2*a* is a detailed perspective view of the bridging arrangement of FIG. 1 with the bridge member in its fully engaged position relative to the modules.
Figure 3A:
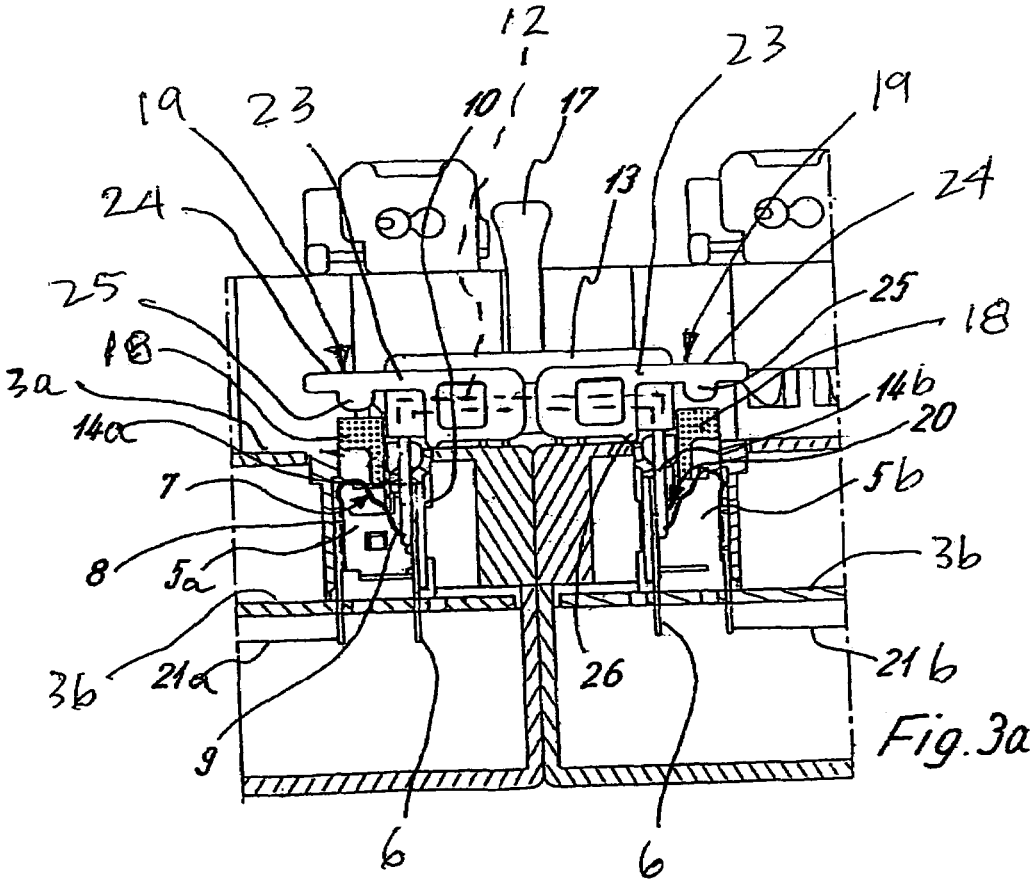
FIG. 3*a* is a corresponding sectional view of the apparatus of FIG. 2*a;*

Referring first more particularly to FIGS. 1, 2*a* and 3*a*, the bridge connector arrangement of the present invention is operable to electrically connect a pair of adjacent control modules 1 and 2 mounted on a support rail R, as is known in the art. Each module includes an electrical housing 4 having a base portion 3 provided with a horizontal top wall 3*a* containing openings in which are mounted female plug-in terminals 5, respectively. In order to connect together a pair of adjacent female terminals 5*a* and 5*b*, bridge connector means 11 are provided that include a bridge body 13 formed from an electrically-insulating synthetic plastic material, said bridge body including an upwardly directed handle portion 17, and a downwardly extending guide projection 15. Embedded in the bridge body are the parallel longitudinally-extending base portions of a plurality of U-shaped bridging conductors 12 having downwardly extending parallel vertical leg portions that define male contacts 14.

Each of the female plug-in terminals includes a row of hollow, vertically arranged cages 6 formed from an electrically-conductive metal, such as copper or brass. The metal cages are connected at their lower ends to the respective ends of parallel spaced internal conductors 21 that are mounted beneath a horizontal intermediate housing wall 3*b*, as shown in FIG. 3*a*. Arranged within each of the cages is an inverted V-shaped clamping spring 7 having a first support leg portion 8 that engages one cage wall, and a second clamping leg portion 9 that is biased toward a stationary contact 10 carried by the opposite cage wall. A movable depressor member 18 is mounted in each cage above the spring clamping leg 9, with the upper ends of the depressor members extending upwardly beyond the horizontal upper surface 3*a* of the housing base portion, as shown in FIGS. 1 and 3*a*.

When the bridge means 11 is manually displaced from the fully disengaged position of FIG. 1 toward the fully engaged position of FIGS. 2*a* and 3*a*, the male contacts 14 of the bridge means are inserted into the cages 6 and are biased by the clamping spring 7 into clamped electrical engagement with the stationary contacts 10 on the walls of the cages 6, respectively. Thus, the conductor 21*a* of module 1 is connected with conductor 21*b* of module 2 via cage 6*a*, stationary contact 10*a*, male contact 14*a*, the base portion of bridging conductor 12, male contact 14*b*, stationary contact 10*b*, and cage 6*b*. The depressor members 18 extend upwardly from the cages 6*a* and 6*b* above the spring clamping legs 9, and protrude upwardly above the top wall 3*a*.

In accordance with the present invention, release members 19 are mounted for swinging movement at each end of the bridge member 13. Each release member has a generally U-shaped cross-sectional configuration and includes a base portion 24 that extends horizontally transversely of the bridge member adjacent the associated end wall thereof, and a pair of leg portions 23 that extend longitudinally adjacent the side walls of the bridge member, respectively. In the illustrated embodiment, the free extremities of the leg portions 23 are resiliently biased inwardly toward frictional engagement with the associated side walls of the bridge member 13. Intermediate the ends of each leg portion 23 is a downwardly extending first integral cam 26 that is arranged for engagement with the upper surface of the associated housing base top wall 3*a*. A second downwardly extending cam 25 is carried by the transverse base portion of the release member above the row of depressor members 18.

Figure 2B:
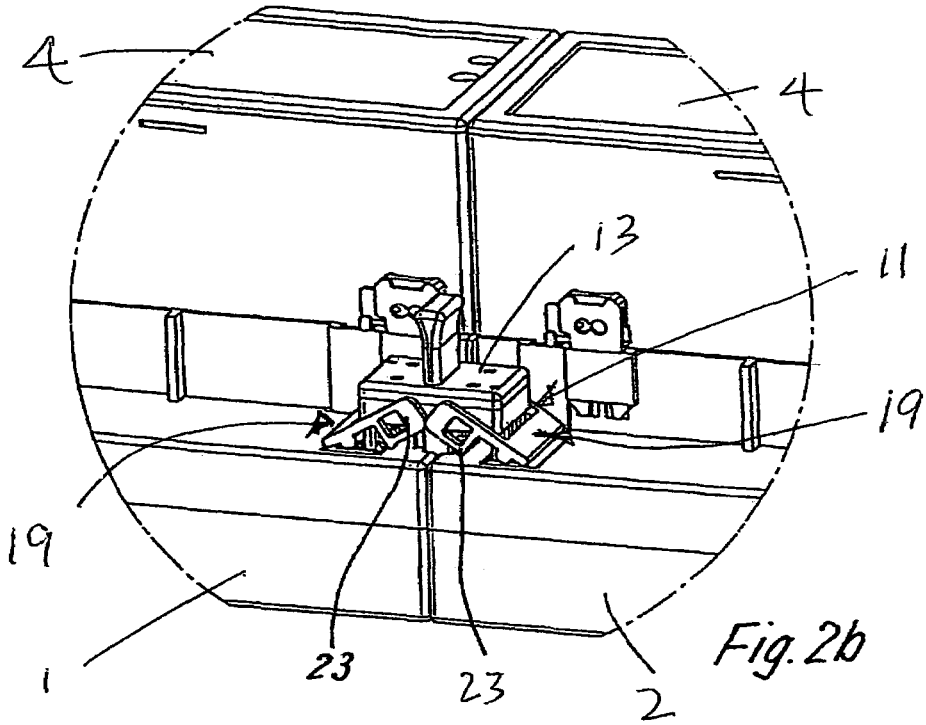
FIG. 2*b* is a detailed perspective view of the bridge member of FIG. 1 in a partially released position.
Figure 3B:
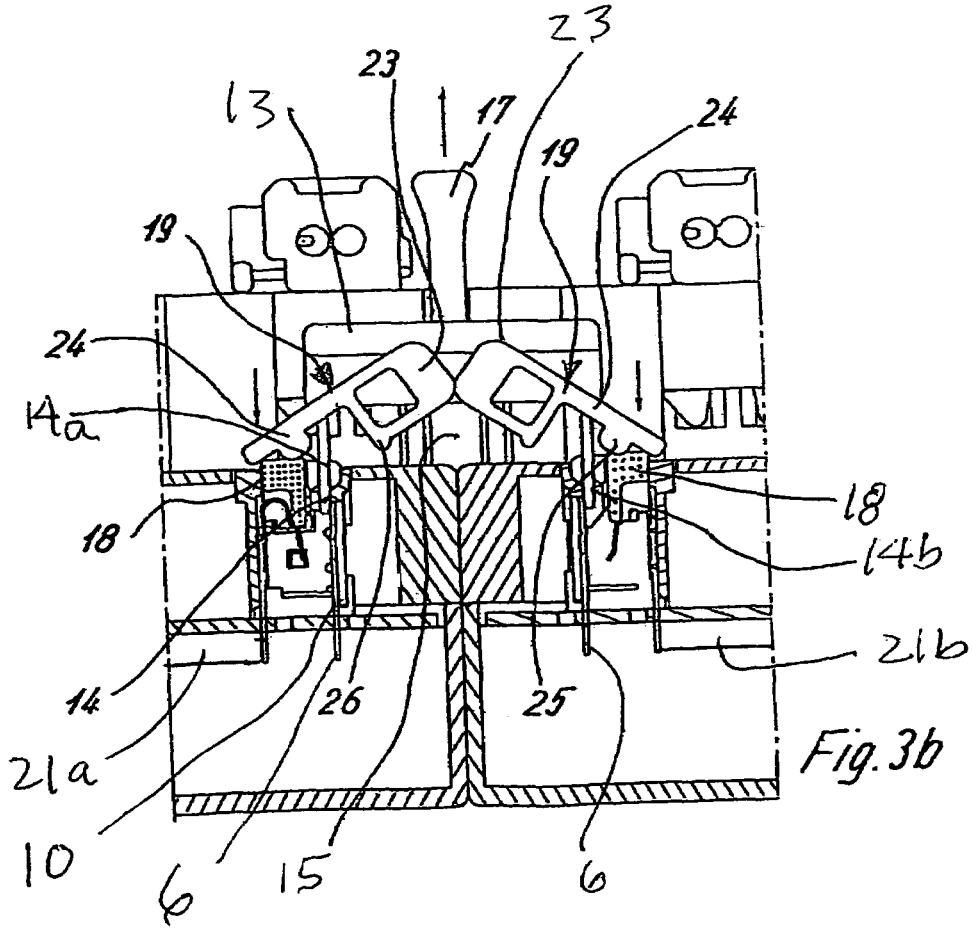
FIG. 3*b* is a sectional view corresponding with FIG. 2*b;*
Figure 2C:
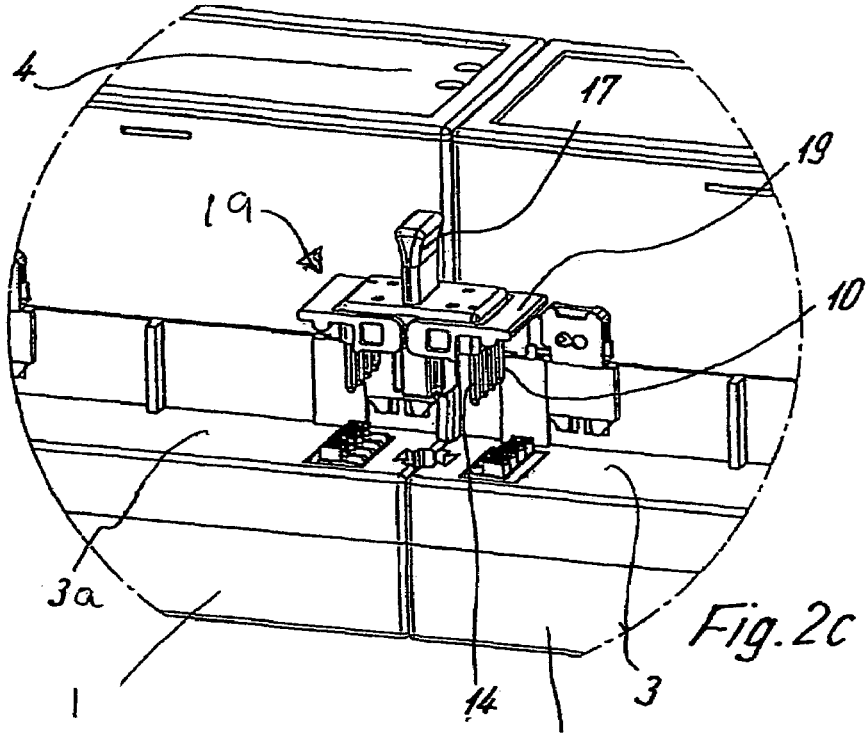
FIG. 2*c* is a perspective view illustrating the bridge member in the fully released position.
Figure 3C:
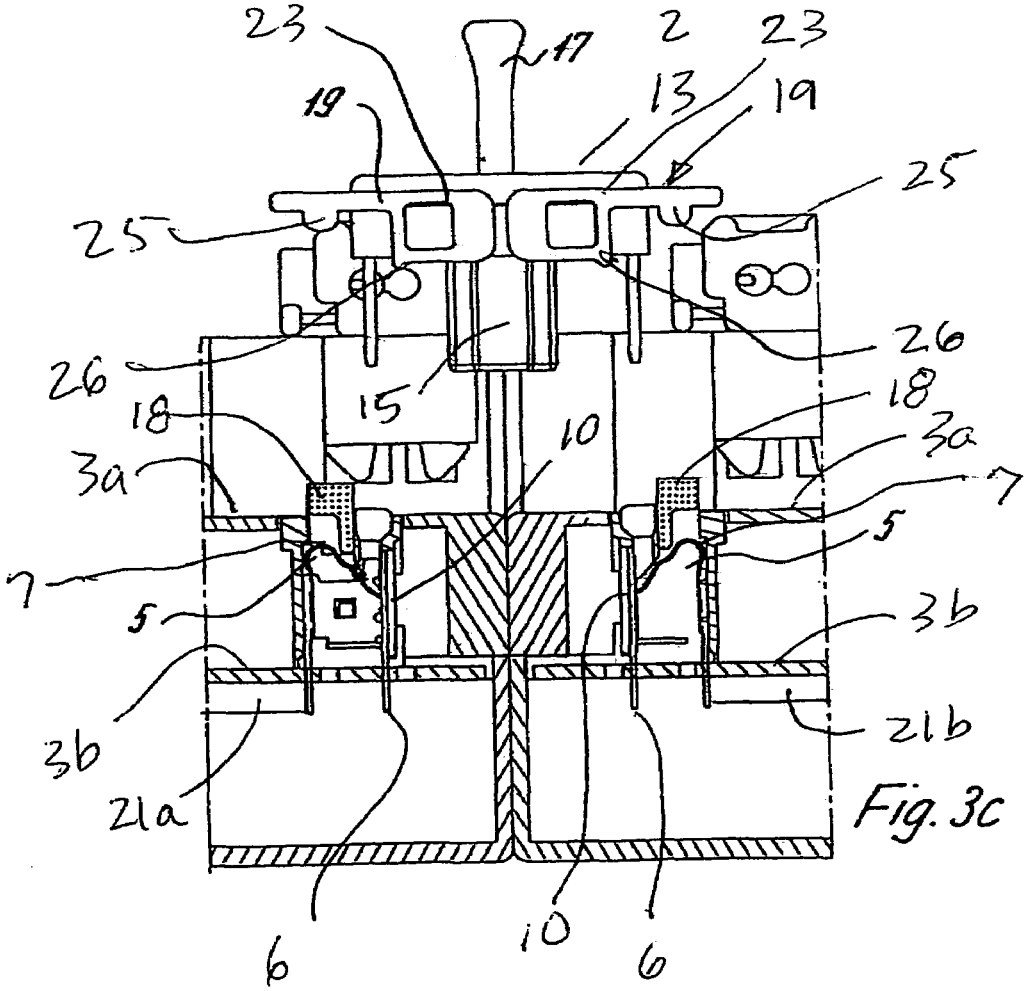
FIG. 3*c* is a sectional view of the apparatus of FIG. 2*c;*

In operation, when the base portions 24 of the release members 19 are manually pressed downwardly as shown in FIGS. 2*b* and 3*b*, the release members pivot about the pivot cams 26, thereby to cause the transverse cam 25 to depress the depressor elements 18 to disengage the spring clamping arms 9 from the associated male contacts 14. Simultaneously, the free end portions of the legs 23 raise the bridge body upwardly relative the modules, thereby to disengage the male contacts 14 from the associated stationary contacts 10. The bridge means 11 may then be manually raised by handle 17 to the fully disengaged position of FIGS. 2*c* and 3*c*, whereupon the electrical connection between the internal conductors 21*a* and 21*b* of the modules is interrupted.

Figure 4:
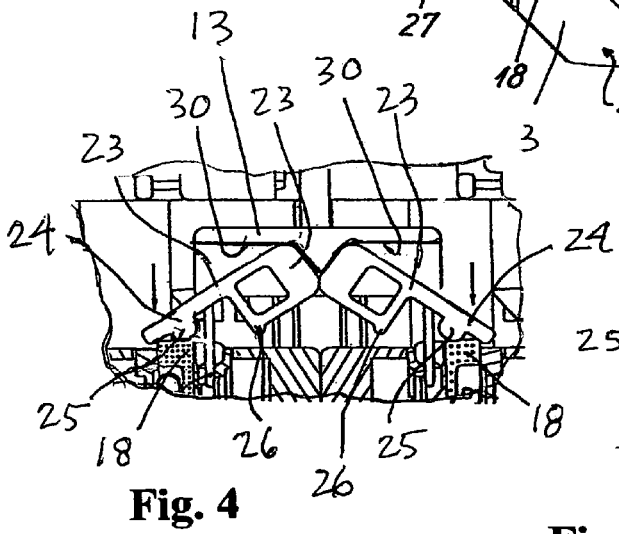
FIG. 4 is a detailed elevational view of an alternate embodiment of the invention wherein the legs of the release members are connected with the bridge member by pivot groove means.
Figure 5:
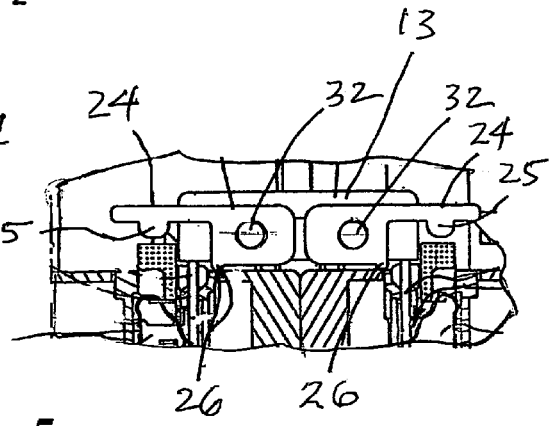
FIG. 5 is a detailed elevational view of an alternate embodiment wherein the legs of the release members are pivotally connected with the bridge member.

In the modification of FIG. 4, the inwardly biased free ends of the leg portions 23 of the release members 19 are received in pivot grooves 30 contained in the side walls of the bridge member. In the embodiment of FIG. 5, the free ends of the release legs 23 are pivotally connected with the bridge member by integral pivot pins 32, thereby to positively connect the release members with the bridge member.

In accordance with another characterizing feature of the invention, the bridge member 13 is provided with a downwardly extending integral guide projection 15 that extends downwardly within a corresponding guide opening 27 defined between the adjacent edges of the top walls 3*a* of the housing base portions of the modules. Preferably, the guide projection is provided with tongues 16 that cooperate with corresponding pivot grooves defined in the walls of the opening 27. Thus, the two modules and the bridge member 13 are fastened together by a mechanical connection to define a rigid assembly that resists relative lateral displacement of the modules, whereby the integrity of the electrical connection produced by the bridging conductors 12 is maintained. Furthermore, the tongue and groove means may be coded so that only predetermined modules may be connected by the bridge connector.

Instead of the provision of separate depressor members 18, it is possible to disengage the spring clamping legs 9 directly by means on the transverse base portion 24 of the release members 19. Furthermore, the cams 26 and 25 could be combined to function as a single cam. If desired, a U-shaped clamping spring could be used in place of the V-shaped spring 7.

While in accordance with the provisions of the Patent Statutes the preferred forms and embodiments of the invention have been illustrated and described, it will be apparent to those skilled in the art that changes may be made without deviating from the invention described above.

What is claimed is:

1. A bridge connector arrangement electrically connecting internal bus conductors of a pair of adjacent electrical modules, comprising:

(a) a pair of adjacent electrical modules (1, 2) each including:

(1) a housing (4) including a base portion (3) having a horizontal top wall (3*a*) and containing a chamber in which are provided a plurality of parallel internal electrical conductors (21);

(2) a row of female plug-in terminal means (5) mounted in openings contained in said base portion upper wall, said female plug-in terminal means being connected with the ends of said internal conductors, respectively;

(b) connecting bridge means (11) operable between engaged and disengaged positions relative to said modules for connecting and disconnecting said female terminal means of said modules, respectively, said bridge means including:

(1) a generally rectangular bridge member (13) having side, end top and bottom walls; and (2) a plurality of bridging conductors (12) carried by each end of said bridge member, said bridging conductors having male plug contacts (14) that extend, when said bridge means is in said engaged position, into said female plug-in terminal means, respectively;

(c) a plurality of clamping springs (7) arranged in said female plug-in terminals, respectively, said clamping springs clamping said male plug contacts in electrical engagement with said female plug-in terminals, respectively; and (d) release means carried by said bridge member releasing said clamping springs from said male plug contacts, and simultaneously displacing said bridge member from said engaged position to said disengaged position;

said release means includes at least one release member (19) connected for swinging displacement relative to one end of said bridge member, and said release means includes a pair of said release members (19) arranged at opposite ends of said bridging member, each of said release members having a generally U-shaped cross-sectional configuration and including a base portion (24) that extends transversely adjacent one end wall of said bridge member, and a pair of arm portions (23) that extend longitudinally inwardly on opposite sides of said bridge member.

2. A bridge connector arrangement as defined in claim 1, and further including pivot means (32) connecting said release members for pivotal movement relative to said bridge member.

3. A bridge connector arrangement as defined in claim 1, wherein said bridge member includes an upwardly extending handle (17).

4. A bridge connector arrangement as defined in claim 1, wherein said release member arm portions have free end portions that are resiliently biased together into frictional engagement with the adjacent side surfaces of said bridge member.

5. A bridge connector arrangement as defined in claim 4, wherein the side walls of said bridge member contain pivot grooves (30) that receive the free end portions of said release member arm portions, thereby to support said release members for pivotal movement relative to said bridge member.

6. A bridge connector arrangement as defined in claim 1, wherein said release member arm portions include intermediate their ends downwardly extending first cams (26) arranged for engagement with the adjacent top surface (3*a*) of the associated module housing, whereby upon downward displacement of said release member base portions relative to said bridge member, said release members are pivoted in a releasing direction about said first cams to displace said bridge member upwardly toward said disengaged position relative to said modules.

7. A bridge connector arrangement as defined in claim 6, wherein each of said female plug-in terminals includes a hollow conductive metal cage (6) connected with an associated internal conductor, said cage having a pair of parallel spaced vertical walls a first one of which supports a stationary cage contact (10); and further wherein said clamping spring has an inverted generally V-shaped configuration including a support leg (8) in engagement with the second one of the vertical cage walls, and a clamping leg (9) that is biased toward said stationary cage contact, thereby to bias the associated bridge conductor male contact (14) toward clamped electrical engagement with said stationary cage contact.

8. A bridge connector arrangement as defined in claim 7, wherein said bridge member includes a plurality of generally U-shaped bridging conductors (12) having parallel base portions contained in said bridge member, and parallel leg portions that define said male bridging contacts (14).

9. A bridge connector arrangement as defined in claim 8, and further including a plurality of depressor members (18) arranged for vertical movement in said cages above said spring clamping legs, respectively, said depressor elements having upper ends that protrude upwardly from said female plug terminals, respectively; and further wherein said release member base portions include downwardly extending second cams (25) for operating said depressor elements simultaneously when said release members are pivoted in the releasing direction about said first cams, thereby to release said spring clamping legs from the associated bridging male contacts, respectively.

10. A bridge connector arrangement as defined in claim 8, wherein said release member base portions include extension means for disengaging said spring clamping legs from said male bridging contacts when said releasing members are pivoted in the releasing direction about said first cams, respectively.

11. A bridge connector arrangement as defined in claim 8, wherein all of said male bridging contacts are vertical, thereby to permit manual tool-free vertical plug-in connection of said bridging member relative to said modules and to said female terminal means, respectively.

12. A bridge connector arrangement as defined in claim 8, wherein said bridging conductor base portion includes a series-connected fuse.

13. A bridge connector arrangement as defined in claim 8, wherein said bridging conductor base portion includes a series-connected light emitting diode.

14. A bridge connector arrangement as defined in claim 1, and further including: (e) a guide projection (15) integral with, and projecting downwardly from, said bridge member, said guide projection extending into a corresponding guide opening (27) contained in the adjacent side edge portions of said base top walls of said modules.

15. A bridge connector arrangement as defined in claim 14, and further including tongue and groove means (16, 27) associated with said guide projection and said guide opening for mechanically connecting said bridge member with both of said modules.

16. A bridge connector arrangement as defined in claim 15, wherein said tongue and groove means are coded to permit connection of said bridge member only with a predetermined module.

* * * * *